US007584771B2

(12) United States Patent
Herre et al.

(10) Patent No.: US 7,584,771 B2
(45) Date of Patent: Sep. 8, 2009

(54) METHOD AND APPARATUS FOR DELIVERING PAINT TO AN APPLICATOR AND FLUSHING SAME

(75) Inventors: Frank Herre, Oberriexingen (DE); Rainer Melcher, Oberstenfeld (DE); Herbert Martin, Weinstadt (DE); Michael Baumann, Flein (DE); Richard M. Ostin, Farmington, MI (US); Robert F. Heldt, Oxford, MI (US); Manfred Michelfelder, Höpfigheim (DE); Joachim Hering, Duermentingen (DE)

(73) Assignee: Durr Systems, Inc., Auburn Hills, MI (US)

( * ) Notice: Subject to any disclaimer, the term of this patent is extended or adjusted under 35 U.S.C. 154(b) by 604 days.

(21) Appl. No.: 10/512,929

(22) PCT Filed: May 6, 2003

(86) PCT No.: PCT/US03/14229

§ 371 (c)(1),
(2), (4) Date: Oct. 19, 2005

(87) PCT Pub. No.: WO03/095308

PCT Pub. Date: Nov. 20, 2003

(65) Prior Publication Data

US 2006/0086407 A1 Apr. 27, 2006

(30) Foreign Application Priority Data

Jan. 20, 2003 (DE) ..... 1031942

(51) Int. Cl.
*B65B 1/04* (2006.01)
*B08B 9/00* (2006.01)

(52) U.S. Cl. ..... 141/91; 141/9; 141/90; 134/22.12; 134/38

(58) Field of Classification Search ..... 141/9, 141/69, 90–92; 239/3, 690; 134/8, 22.11, 134/22.12, 38
See application file for complete search history.

(56) References Cited

U.S. PATENT DOCUMENTS

| | | | |
|---|---|---|---|
| 3,108,012 | A | 10/1963 | Curtis |
| 5,803,109 | A | 9/1998 | Rosen |
| 5,882,428 | A | 3/1999 | Gawne |
| 6,401,768 | B2 | 6/2002 | Lichte et al. |

FOREIGN PATENT DOCUMENTS

DE 19830029 1/2000

(Continued)

OTHER PUBLICATIONS

Supplementary European Search Report.

*Primary Examiner*—Timothy L Maust
(74) *Attorney, Agent, or Firm*—Howard & Howard Attorneys PLLC

(57) ABSTRACT

The disclosed apparatus includes a supply line (22) between a source of liquid paint (64) and an applicator (62) having at least two pigs (20A and 20B) and a source of liquid solvent (60) which delivers solvent (60) between the two pigs (20A and 20B) and the pigs (20A and 20B) are driven by paint (80) from adjacent the paint source (64) to the applicator (62). The apparatus further includes a second source of liquid solvent (60) which delivers solvent (60) between the pigs (20A and 20B) adjacent the applicator (62) and the pigs (20A and 20B) are returned through the supply line (22), thereby flushing the supply line (22). In the disclosed embodiment, the source of liquid paint (64) is a piston dosing device (70) which receives paint (80) from a color changer or the like and delivers a predetermined volume of paint (80) to the applicator (62). The delivery line (22) preferably includes a friction resistant inner layer, an intermediate dielectric layer and a protective outer layer.

17 Claims, 7 Drawing Sheets

FOREIGN PATENT DOCUMENTS

| | | | |
|---|---|---|---|
| DE | 19830029 | A1 | 1/2000 |
| DE | 19937426 | A1 | 3/2001 |
| EP | 1108474 | A2 | 6/2001 |
| EP | 1 172 152 | A1 | 1/2002 |
| EP | 1172152 | A1 * | 1/2002 |
| EP | 1 172 153 | B1 | 8/2003 |
| EP | 1172152 | B1 | 8/2003 |
| EP | 1108474 | A3 | 10/2003 |
| EP | 1108474 | B1 | 11/2004 |
| GB | 2000570 | A | 1/1979 |
| WO | 03095106 | | 11/2003 |

* cited by examiner

METHOD AND APPARATUS FOR DELIVERING PAINT TO AN APPLICATOR AND FLUSHING SAME

FIELD OF THE INVENTION

The present invention relates to a method and apparatus for delivering paint from a source of liquid paint to an applicator and flushing the delivery line and the applicator with solvent using pigging technology.

BACKGROUND OF THE INVENTION

The prior art discloses numerous paint delivery and application systems using pigging technology. Such systems may be used to apply seriatim paints of different colors, for example, to a plurality of substrates, such as vehicle bodies moving on a conveyor through a paint booth. As used herein, the term "paint," includes solvent or water based paints used to paint or coat a substrate and generally any coating which may be applied to a substrate by an applicator including but not limited to a rotary spray atomizer. Depending on its function in the coating delivery system, pigs or pigging elements are variously referred to in the prior art as shuttles, separating elements, terminating pistons, plugs, etc. Generally, a pigging element is utilized in the prior art paint delivery systems to push paint from a source of paint, such as a color changer, through a delivery line to an applicator to apply paint to a substrate and the pigging element may also be utilized to return paint to the source of paint. As will be understood by those skilled in this art, a typical mass production application such as an automotive application, requires the application of different paints utilizing the same paint application system thus requiring purging of the delivery line and the applicator with solvent between applications. Typically, this requires a separate solvent delivery line to the applicator. The paint application system may include a first pig station adjacent the color changer and a second pig station adjacent the applicator. Paint is then delivered under pressure from the color changer to the delivery line and the pigging element is driven through the supply line generally by pneumatic pressure to push the paint in the supply line to the applicator and the pigging element is then received in the second pig station adjacent the applicator. The pigging element may also be utilized to return paint remaining in the supply line to the color changer by driving the pigging element from the second pigging station adjacent the applicator to the first pigging station adjacent the color changer generally under pneumatic pressure.

Finally, the prior art also includes the use of two or more pigging elements in the supply line which are utilized to separate a predetermined volume of paint or to provide an electrostatic barrier between volumes of paint which are being transmitted through the supply line particularly where the color change is at ground potential and the applicator is an electrostatic paint applicator at a greater electrical potential.

However, the prior art does not disclose a method or apparatus which eliminates the requirement for a separate solvent supply line to purge the applicator and the supply line and which may be utilized to return paint to the paint source.

SUMMARY OF THE INVENTION

The apparatus for conveying paint from a paint source to an applicator of this invention includes a paint supply line between the paint source and the applicator delivering paint under pressure from the paint source to the applicator, a first pig station adjacent the paint source and a second pig station adjacent or within the applicator, which may be an atomizer, a first and second pig or pigging element movable in the supply line between the first pig station and the second pig station and a source of liquid solvent connected to the first and/or to the second pig station adapted to deliver solvent under pressure between the first and second pigs, whereby movement of the first and second pigs between the first and second stations may deliver solvent to the applicator or the paint source, thereby flushing the applicator, the supply line, and/or the source. In the preferred embodiment, the source of liquid paint is a cannister receiving paint from a source of liquid paint, such as a color changer, having a piston, whereby movement of the piston supplies paint under pressure through the supply line to the applicator. The paint cannister includes an outlet communicating with the first pig station, whereby movement of the piston drives paint against an adjacent pigging element, thereby driving the first and second pigging elements with solvent therebetween from the first pig station to the second pig station first delivering solvent through the paint supply line to the applicator, purging the paint supply line and the applicator, and then delivering paint through the supply line to the applicator to apply paint to a substrate.

In a preferred embodiment, the apparatus further includes a source of liquid solvent under pressure connected either to the supply line adjacent the second pig station or connected to the second pig station which delivers solvent under pressure between the first and second pigs and the first and second pigs are driven under pressure, preferably pneumatic pressure, from the second pig station to the first pig station. The solvent between the first and second pigging elements thereby purges the supply line and the paint cannister prior to receiving a second paint. This embodiment may also be utilized to return paint to the paint source which, in the disclosed embodiment, is a paint cannister having a piston as described above and the paint may then be delivered by the paint cannister to the color changer.

The method of delivering solvent and paint from a source of liquid paint to an applicator through a delivery line having first and second pigs or pigging elements of this invention thus includes locating the first and second pigs adjacent the source of liquid paint, delivering solvent under pressure between the first and second pigs, thereby spacing the first and second pigs with solvent, and driving paint under pressure against the pigging element adjacent the paint source, thereby driving the first and second pigs with the solvent therebetween to the applicator, whereby the solvent is received through the delivery line and the applicator followed by paint to apply paint to a substrate. Where the source of liquid paint is a cannister receiving liquid paint having a piston, as described above, the method of this invention includes driving the piston in the cannister, thereby driving paint against the adjacent pigging element and driving the paint and solvent to the applicator, as described. In a preferred embodiment of the method of this invention, the method further includes delivering solvent under pressure between the first and second pigging elements when the first and second pigging elements are located adjacent the applicator and then driving the first and second pigging elements with solvent therebetween to the source of liquid paint, thereby flushing the delivery line and the paint cannister. A preferred embodiment of the method of this invention further includes driving the first and second pigs from the applicator to the source of liquid paint, thereby driving paint remaining in the supply line to the paint source.

In the preferred embodiment of the apparatus and method of this invention, the pigs or pigging elements each include a body portion having a diameter adjacent its opposed ends substantially equal to or greater than the internal diameter of the delivery line. In one preferred embodiment, the opposed end portions of the pigging elements each include a generally frustoconical resilient skirt portion which tapers outwardly from the body portion having a diameter equal to or greater than the internal diameter of the tubular delivery line providing improved wiping or cleaning of the delivery line during the purging cycles. In a preferred embodiment of this invention, the pigging elements further include projecting end portions on the opposed ends of the pigging elements, such that introduction of solvent under pressure will space the pigging elements as described above. That is, introducing solvent under pressure into the delivery line between the pigging elements will be received by the skirt portions of the opposed pigs, separating the pigs with solvent. The opposed end portions are preferably cylindrical having a flat end portion which abuts the adjacent pigging element such that the solvent will space the pigging elements as described even where the delivery line is flexible. In a preferred embodiment, the delivery line is tubular having a friction resistant inner layer, such as a fluorinated hydrocarbon, preferably a clear or translucent fluorinated polymer, such as a perfluoralkoxy resin, an intermediate dielectric material, such as polyethylene, to prevent arcing, and a thin outer layer of a hard plastic to prevent damage to the delivery line formed of a polyamid, for example. The delivery line, depending upon its diameter, is flexible and translucent, permitting visualization of the movement of the pigging elements, paint and solvent through the delivery line.

Other advantages and meritorious features of the paint delivery system and method of this invention will be more fully understood from the following description of the preferred embodiments, the appended claims, and the drawings, a brief description of which follows.

DESCRIPTION OF THE PREFERRED EMBODIMENTS

Figure 1:
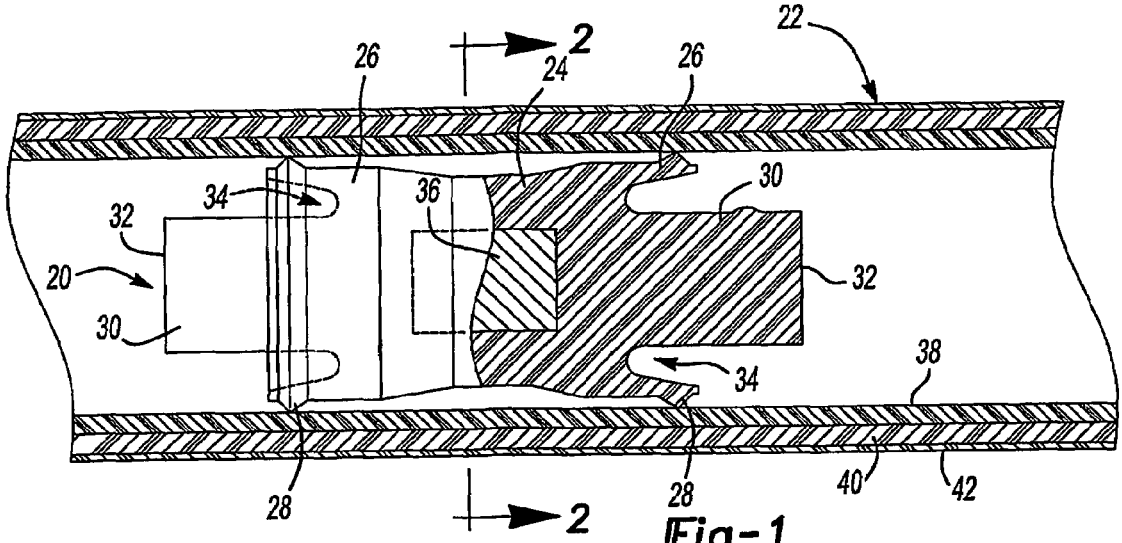
FIG. 1 is a partially cross-sectioned view of a paint delivery line of the apparatus for delivering paint of this invention including a pigging element.
Figure 2:
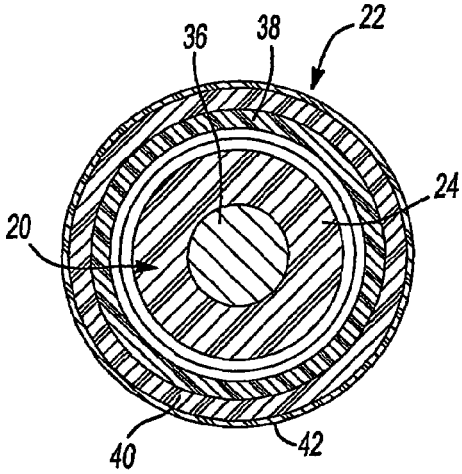
FIG. 2 is a cross-sectional end view of FIG. 1 in the direction of view arrows 2-2.
Figure 3:
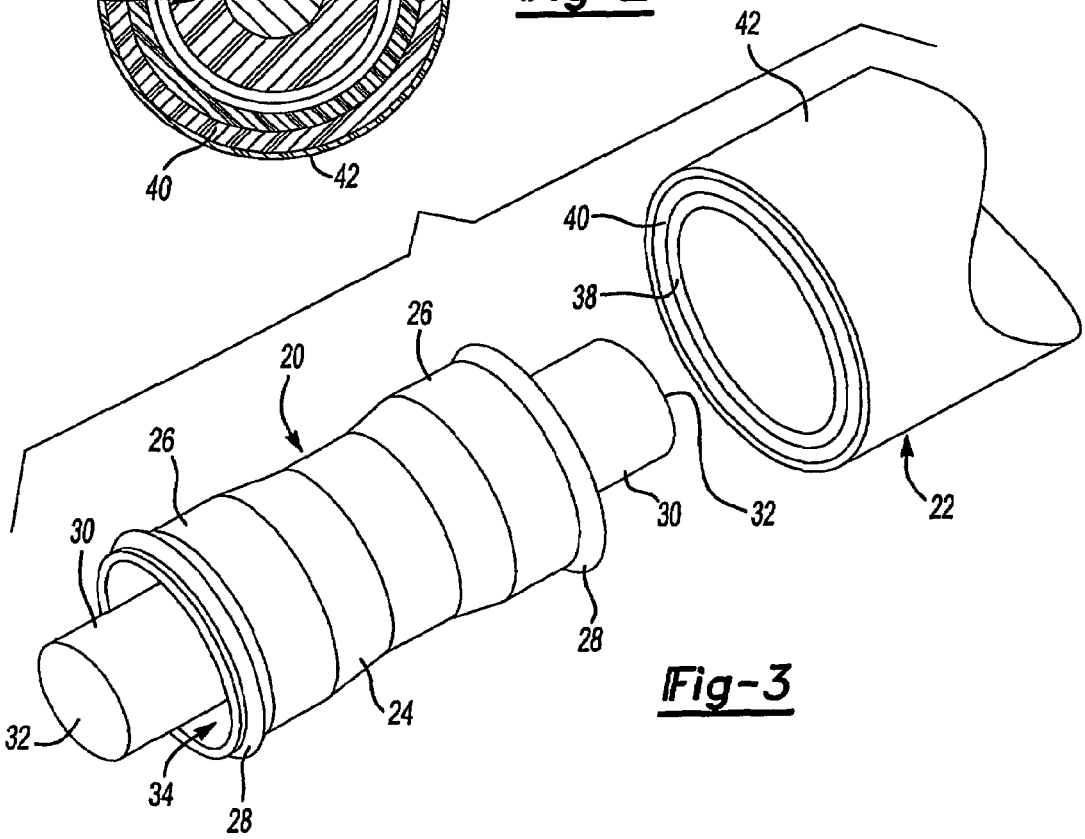
FIG. 3 is an exploded view of the pigging element shown in FIG. 1 and the paint delivery line.

FIGS. 1 to 3 illustrate an embodiment of a pig or pigging element 20 and delivery line 22 which may be utilized in the method and apparatus of this invention as described below. The pigs or pigging elements 20 each include a body portion 24 including generally frustoconical skirt portions 26 on opposed ends of the body portion 24 which angle outwardly from the body portion 24 at an acute angle having annular diamond-shaped rib portions 28 adjacent the ends of the skirt portions 26. In the preferred embodiment, the pig 20 is formed of a resilient polymer, such as polyethylene, and the frustoconical skirt portions 26 have a major diameter which is generally equal to or preferably greater than an internal diameter of the delivery line 22, such that the skirt portions 26 thoroughly scrape the internal surface of the delivery line 22 as the pigging element 20 traverses the delivery line as described below. The preferred embodiment of the pig 20 further includes projecting end portions 30 which project beyond the skirt portions 26 as best shown in FIG. 1 as further described below. In this embodiment, the end portions 30 are cylindrical each having a flat end face 32 which abuts the end face of an adjacent pig 20 as described below in regard to FIGS. 4 and 5. The annular frustoconical skirt portions 26 and the end portions 34 further define annular cavities 34 at the opposed ends of the body portion 26 which are generally wedge-shaped promoting movement of the pig when pressure is received in the wedge-shaped cavities 34 as described below. The preferred embodiment of the pig further includes a sensor element 36 which, in the disclosed embodiment, is a magnet. The sensor element 36 permits accurate determination of the location of the pigging element 20 in the delivery line 22 as described further below.

A preferred embodiment of the delivery line 22 includes an inner layer 38 preferably formed of a friction resistant polymer, for example, a fluorinated polymer, such as a perfluoralkoxy resin, an intermediate layer formed of a dielectric polymer, such as polyethylene to prevent arcing and an outer layer 42 which, in the preferred embodiment, is relatively thin and forms a protective outer shell of the delivery line 22 which may be formed of a polyamid, for example. The layers of the delivery line 22 may be co-extruded, for example, forming an intimate bond between the layers of the delivery line 22 and preventing separation during use. In a preferred embodiment, the delivery line 22 is relatively flexible and clear or translucent to permit visualization of the movement of the pigging element 20, paint and solvent through the delivery line during use, as described below. As will be understood, however, the method and apparatus of this invention are not limited to the disclosed pigging element 20 or delivery line 22 except as specifically claimed hereinbelow.

Figure 4:
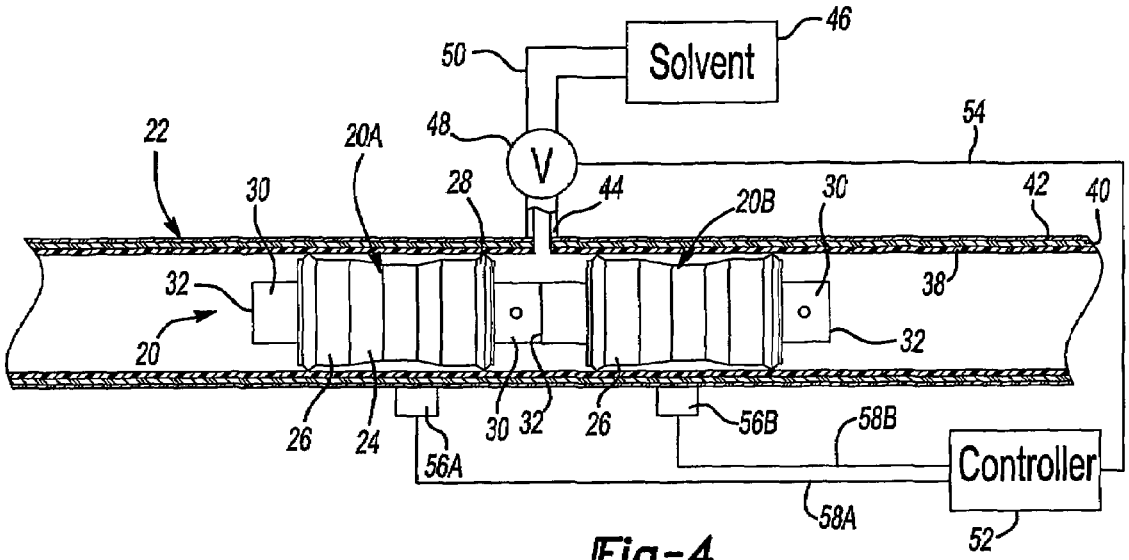
FIGS. 4 and 5 are a partially cross-sectioned view of the paint delivery line with two pigs illustrating one step of the method of delivering paint and solvent of this invention.
Figure 5:
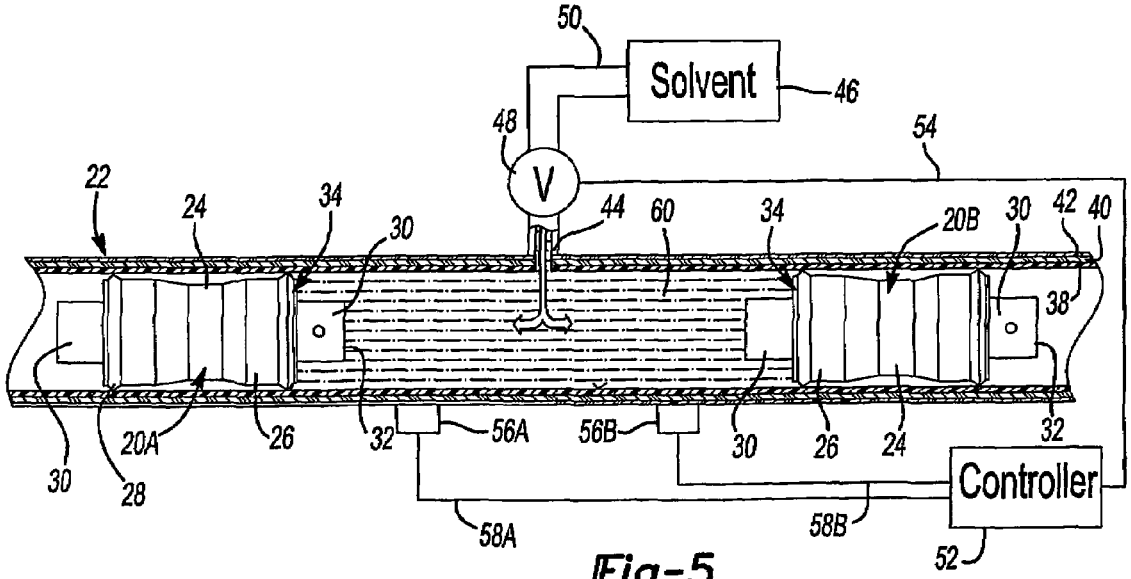

FIGS. 4 and 5 illustrate a component of the apparatus and a step of the method of this invention, wherein the delivery line 22 includes two pigs or pigging elements 20A and 20B each including a body portion 24 having generally frustoconical skirt portions 26 and abutting or nearly abutting cylindrical end portions 30 which extend beyond the generally frustoconical skirt portions 26 of the body portion 24 as described above in regard to FIGS. 1 to 3. The end faces 32 of the end portions 30 are initially abutting as shown in FIG. 4 and generally aligned with a port 44 connected to a source of solvent under pressure 46. An electrically controlled valve 48 is in the line 50 connected to the port 44. The valve 48 is connected to a controller 52 by line 54 and the controller is connected to sensors 56A and 56B by lines 58A and 58B. The sensors 56A and 56B may be any conventional sensor elements, such as a Hall-effect sensor which senses the location of the magnet 36 shown in FIGS. 1 and 2. When the sensors 56A and 56B sense the location of the pigs 20A and 20B in substantially abutting relation opposite the sensor port 44 as shown in FIG. 4, the valve 48 is opened by the controller 52, delivering a predetermined volume of solvent 60 from the source of solvent 46 under pressure between the generally frustoconical skirt portions 26, which separates the pigs 20A and 20B with a predetermined volume of solvent 60 as shown in FIG. 5. The pressure of the solvent 60 is received in the annular cavities 34 of the adjacent pigs 20A and 20B, separating the pigs with solvent 60 as shown in FIG. 5. As described below, a preferred embodiment of the apparatus and method for delivering paint to an applicator of this invention includes two sources of solvent 46A and 46B which separate the pigs or pigging elements 20A and 20B as now described.

Figure 6B:
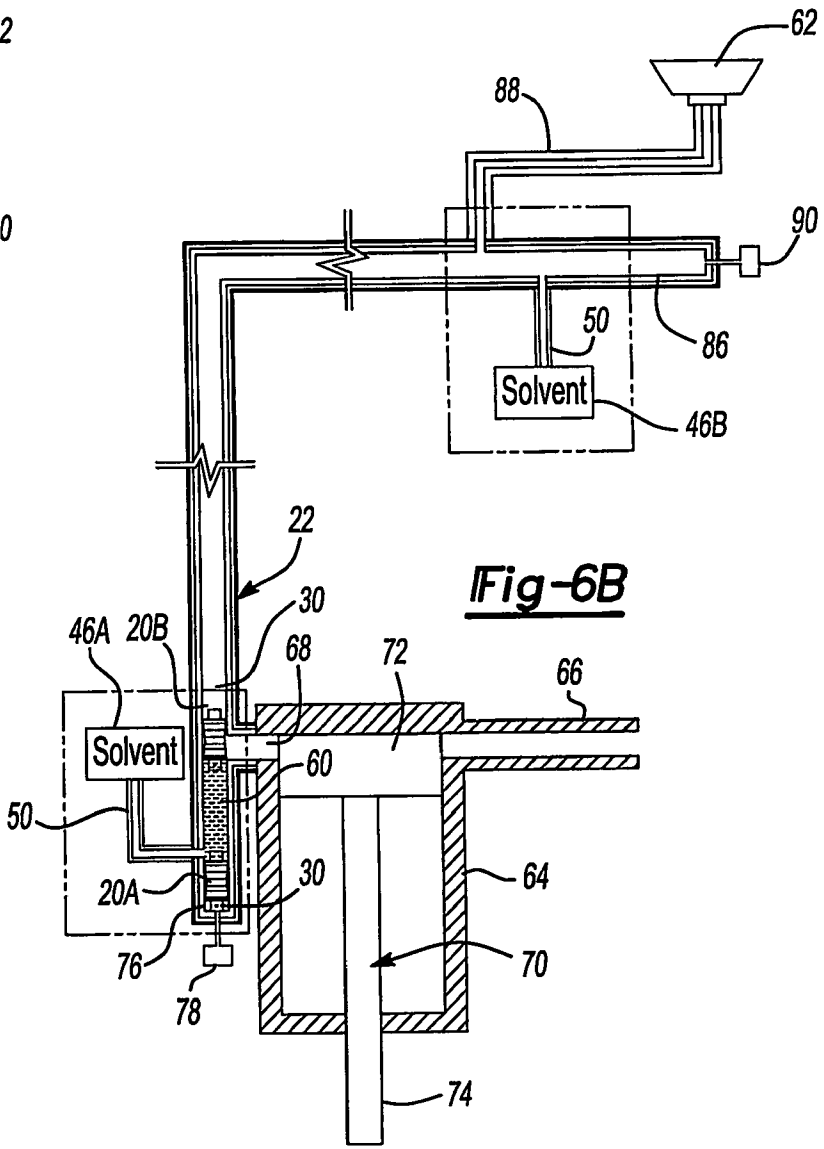
FIGS. 6A to 6J illustrate the method and apparatus for delivering paint to an applicator and flushing of this invention.
Figure 6A:
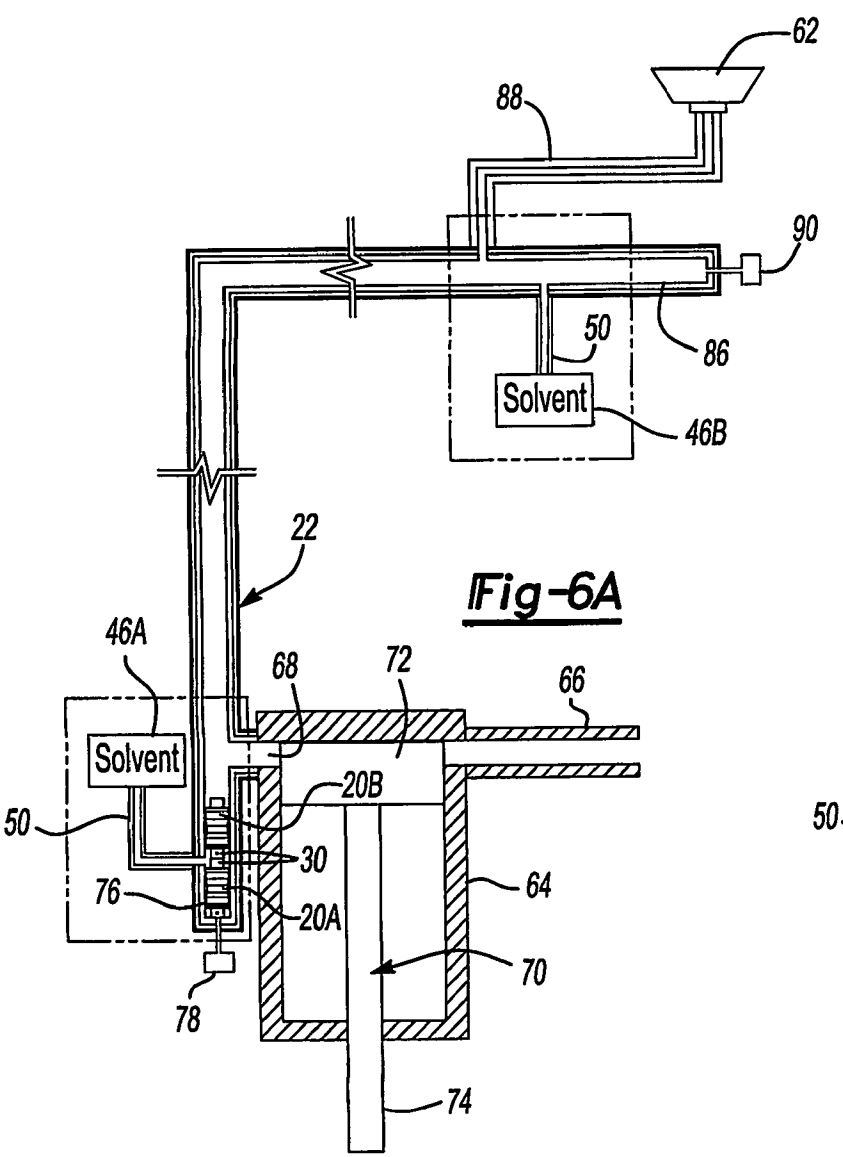

FIGS. 6A to 6J illustrate an embodiment of the apparatus for delivering paint and solvent to an applicator 62 and method of this invention, which may be a conventional electrostatic rotary atomizer or other suitable paint applicator known to this art. As will be understood by those skilled in this art, the applicator 62 is conventionally maintained at a high electrical potential and the source of paint, such as a color changer (not shown), is normally maintained at ground potential. In the preferred embodiment, the apparatus includes a paint cannister 64 having an inlet 66 connected to a source of liquid paint, such as a color changer (not shown), and an outlet 68 communicating with the delivery line 22 described above. The paint cannister includes a piston 70 having a piston head 72 and a shank or piston rod 74 driven by a servomotor or the like (not shown), such that the piston 70 delivers a predetermined volume or "dose" of paint through the delivery line 22 to the applicator 62 as described below. Thus, the cannisters 64 may also be characterized as paint "dosing cylinders." The pigging elements 20A and 20B are initially located in a first pig station 76 which, in the preferred embodiment, is a trunk line of the delivery line 22, such that paint may be delivered directly to the delivery line 22 without flowing around the pigging elements 20A and 20B. The first step in the method of this invention is to locate the pigging elements 20A and 20B in the first pig station 76 adjacent the dosing cylinder 64, such that the projecting cylindrical end portions 30 abut or nearly abut and are located opposite the solvent delivery line 50 connected to a source of solvent under pressure 46A. As will be understood, the first pig station or trunk line 76 includes a valve 48, a controller 52 and sensors 56A and 56B as described above with regard to FIGS. 4 and 5, the details of which are not shown in FIGS. 6A to 6J. The second step in the method of this invention is to separate the pigging elements 20A and 20B with solvent 60 as shown in FIG. 6B and described above with regard to FIG. 5.

Figure 6D:
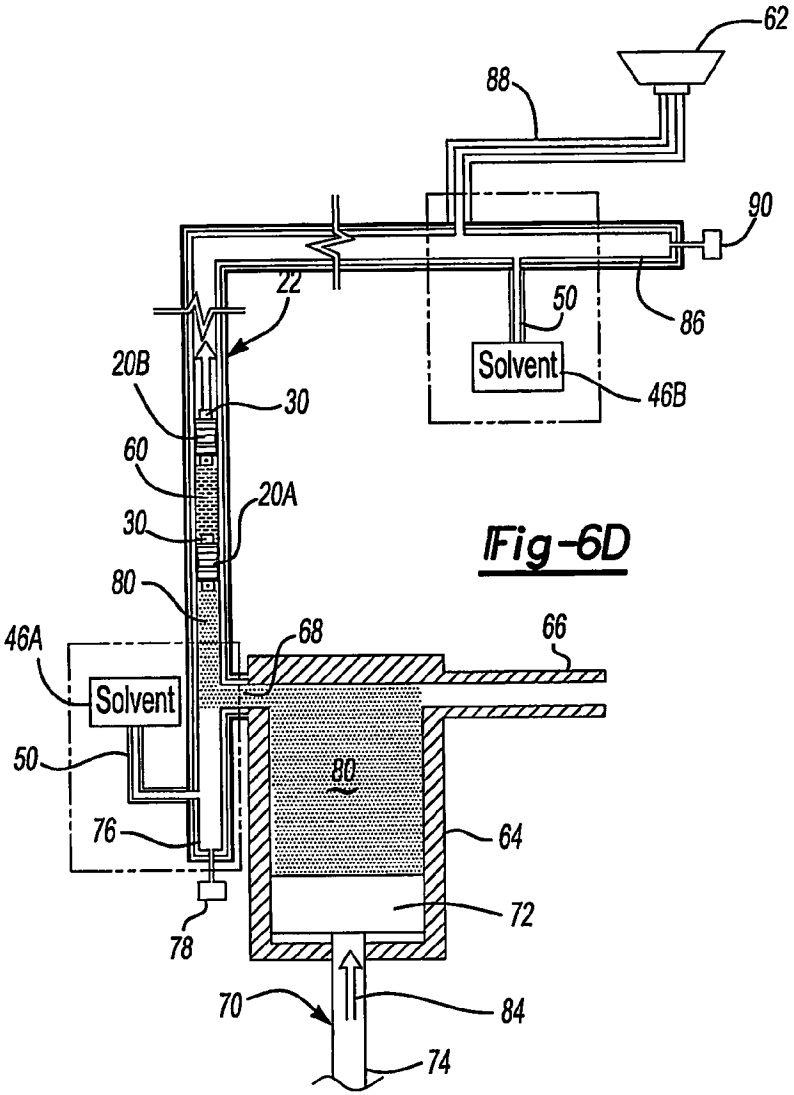
Figure 6C:
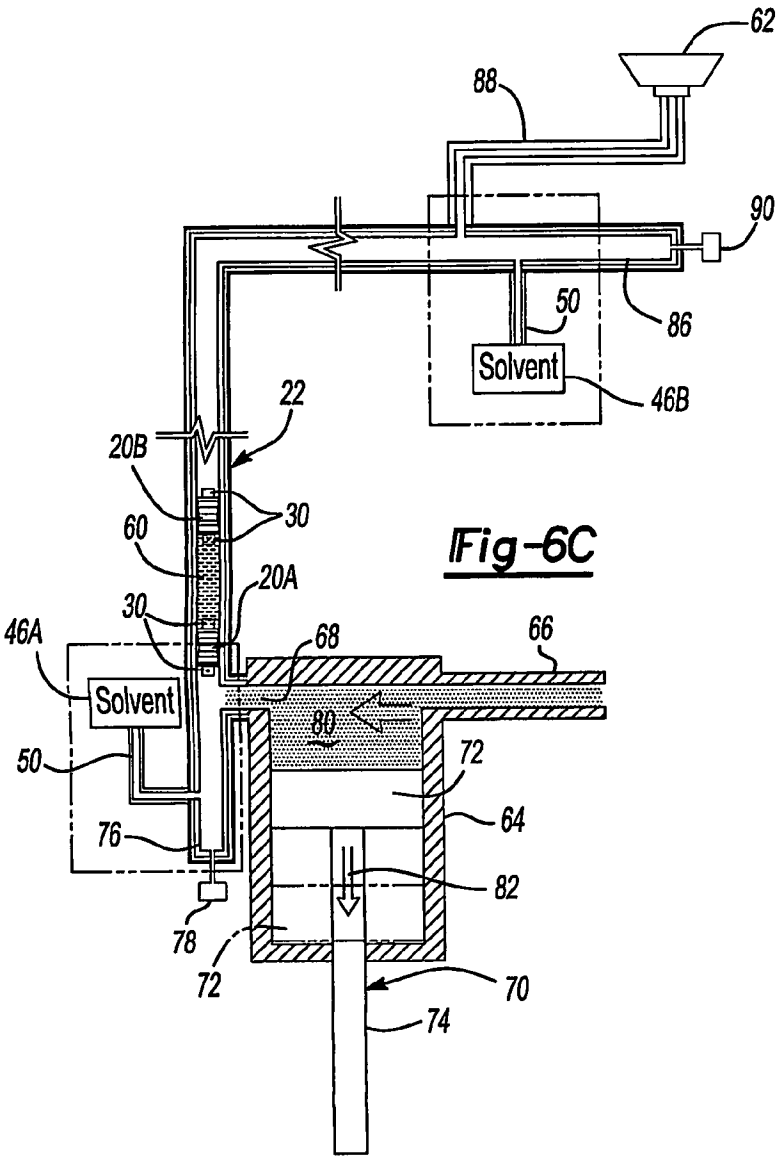
Figure 6F:
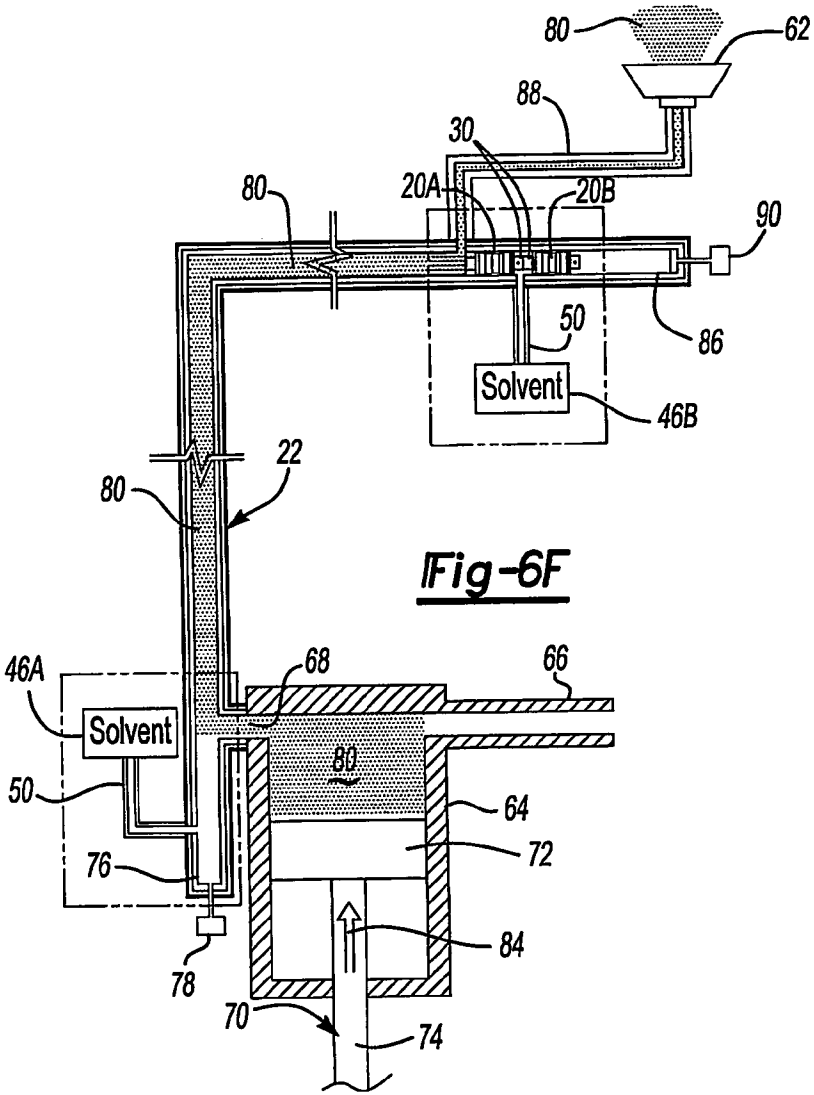
Figure 6E:
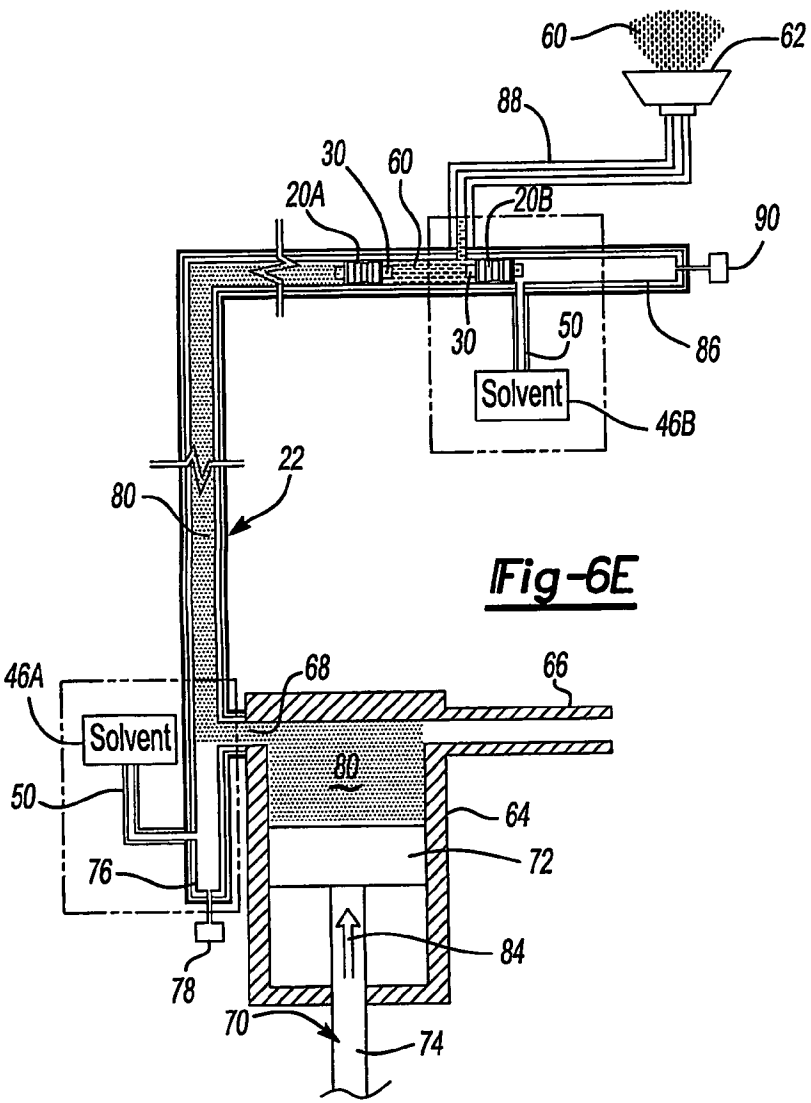
Figure 6H:
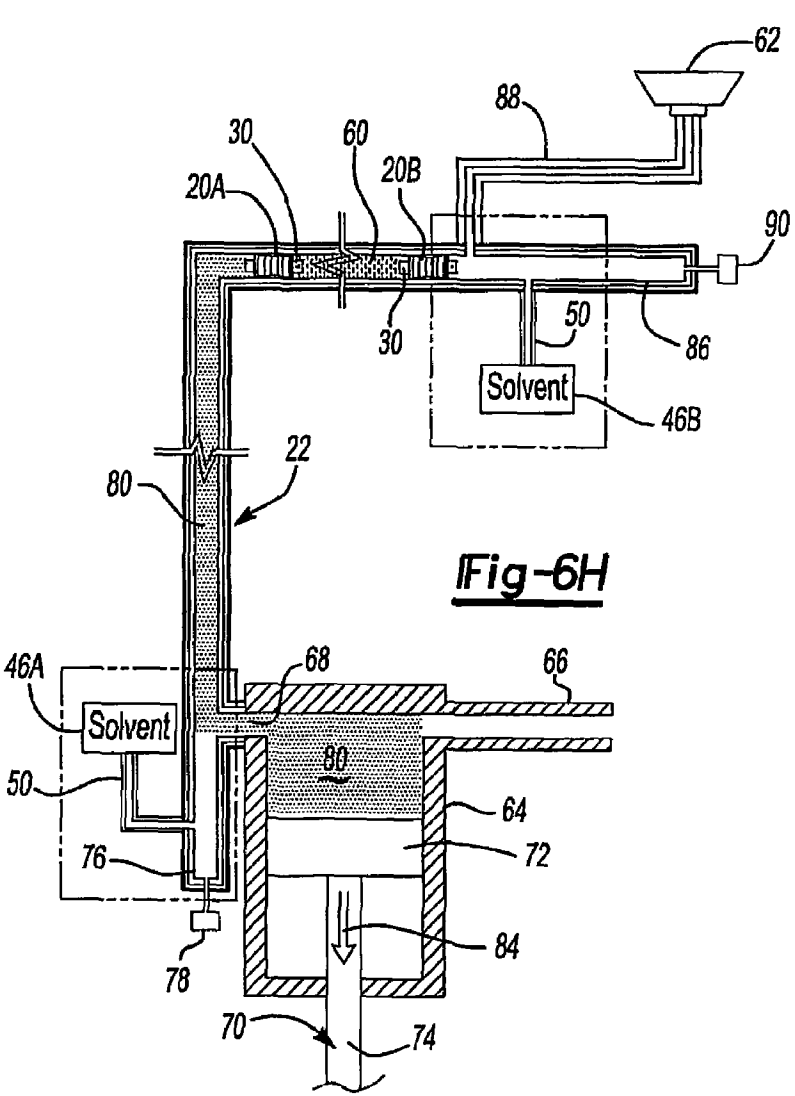

The pigging elements 20A and 20B are then located in the delivery line 22 adjacent or opposite the outlet 68 of the cannister or dosing cylinder 64 as shown in FIG. 6C by any suitable means, such as by delivering air under pressure into the first pig station 76 from a source of pneumatic pressure 78. Liquid paint is then delivered under pressure to the cannister or dosing cylinder 64 through inlet 66 from a source of liquid paint under pressure, such as a color changer (not shown) as shown in FIG. 6C. As set forth above, the shank or piston rod 74 is withdrawn by the servomotor (not shown) a predetermined distance as shown by arrow 82 in FIG. 6C to receive a predetermined volume or dose of paint 80 in the dosing cylinder 64. The direction of travel of the piston 70 is then reversed as shown by arrow 84 in FIG. 6D, which drives paint from the cannister or dosing cylinder 64 through outlet 68 against an adjacent pigging element 20A with solvent 60 between the pigging elements 20A and 20B as shown in FIG. 6D. The paint then drives the pigging elements 20A and 20B through the delivery line 22 toward the applicator 62 as shown in FIG. 6E, wherein the second pigging element 20B is received in a second pig station 86, which is also preferably a trunk line of the delivery line 22. The solvent 60 is then delivered through line 88 to the applicator 62 as shown in FIG. 6E, thereby flushing the applicator 62.

Figure 6G:
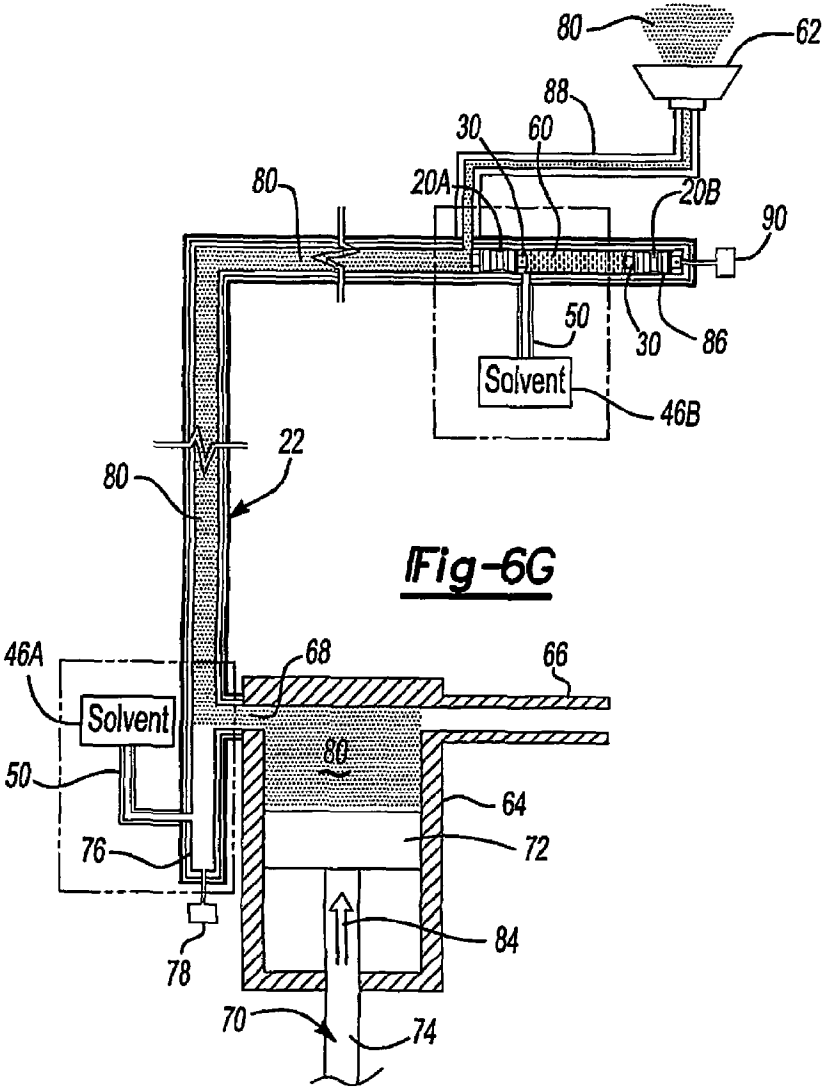

As will be understood from the description of the method and apparatus of this invention thus far, the solvent 60 also flushes the delivery line 22 upstream of the paint 80. The first pigging element 20A is then received in the second pigging station 86 and paint is delivered through line 88 to the applicator 62 as shown in FIG. 6F. As the paint 80 is delivered to the applicator 62 by the piston 70 of the paint dosing cylinder 64, the first and second pigging elements 20A and 20B are located in the trunk line or second pigging station 86 with the projecting end portions 30 in abutting or nearly abutting relation opposite the solvent delivery line 50 of a second source of solvent 46B as shown in FIG. 6F, such that the pigging elements 20A and 20B may be separated with solvent 60 therebetween as shown in FIG. 6G and described above with regard to FIGS. 5 and 6B. As will be understood, the second pig station or trunk line 86 may be identical to the arrangement shown in FIGS. 4 and 5 and includes a valve 48, controller 52, and sensor elements 56A and 56B as shown in FIG. 5. As shown in FIG. 6G, the solvent 60 may be introduced between the first and second pigging elements 20A and 20B as the paint 80 is delivered to the applicator 62 to reduce cycle time, but may also be introduced following delivery of paint to the applicator. The first and second pigging elements 20A and 20B are then delivered to the delivery line 22 (FIG. 6H) preferably by delivery of a nonconductive fluid from a source of nonconductive fluid, such as air 90, which electrically isolates the paint cannister or dosing device 64 from the electrostatic applicator 62 during return of paint 80 remaining in the delivery line 22 to the ultimate source of paint, such as a color changer (not shown) as now described.

Figure 6J:
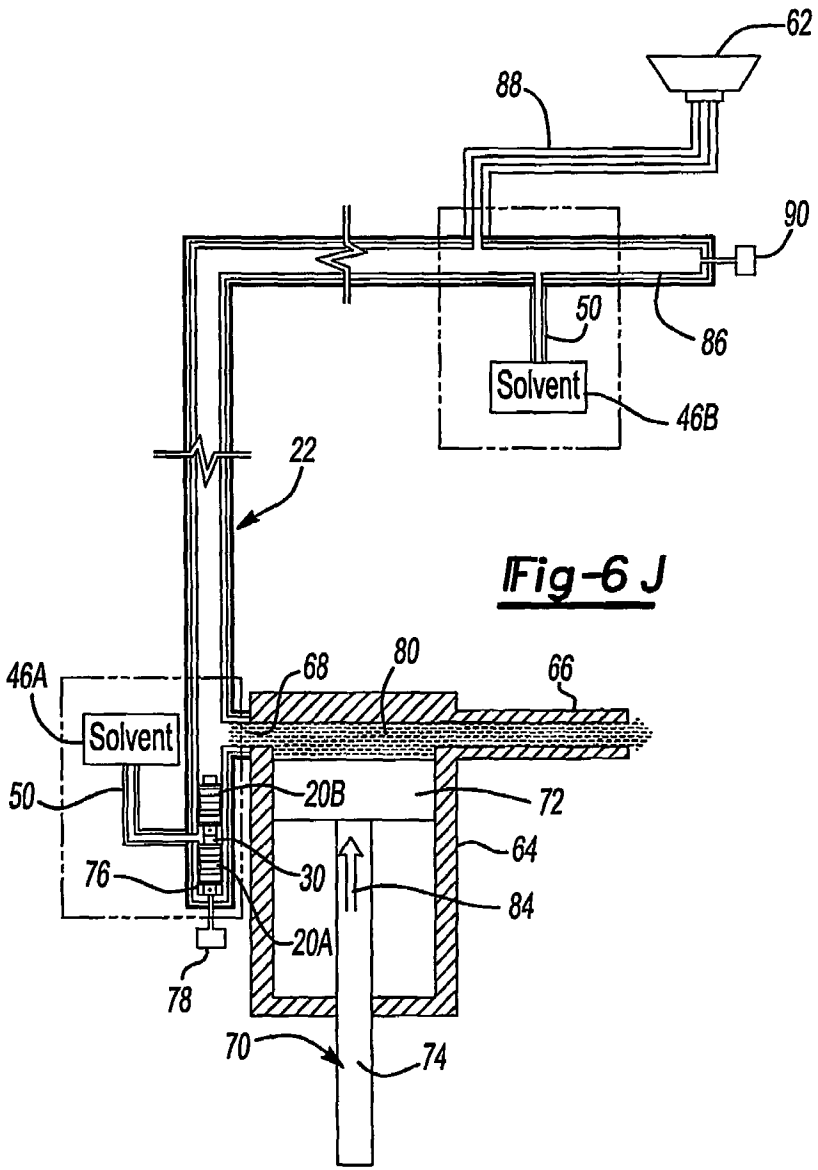
Figure 6I:
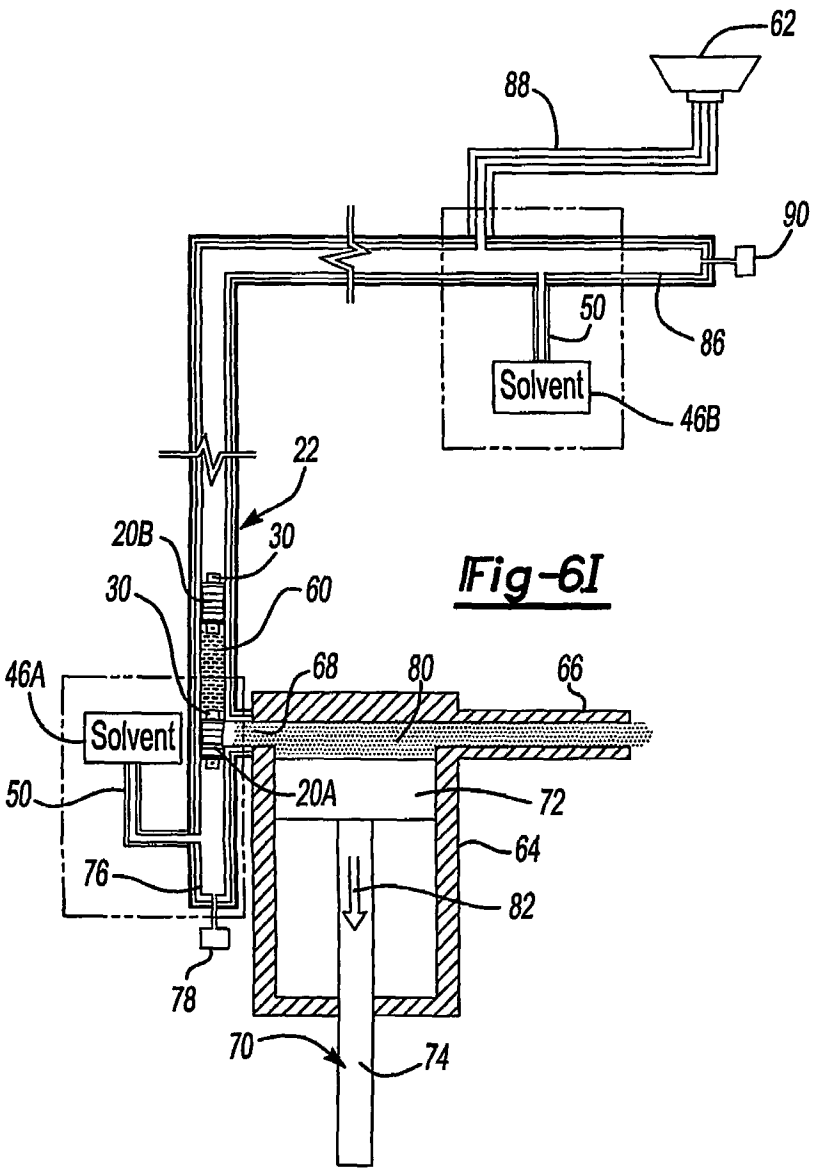

As shown in FIG. 6I, the pneumatic pressure from the source of pneumatic pressure 90 drives the first and second pigging elements 20A and 20B through the delivery line 22 to the first pig station 76 adjacent the paint cannister or dosing device 64. As the solvent 60 between the first and second pigging elements 20A and 20B is received through the delivery line 22, the solvent washes or purges the delivery line of paint. Further, as described above, the pigging elements 20A and 20B having generally frustoconical end portions 26 (see FIGS. 1 to 3) effectively wipe and purge the delivery line 22 particularly in combination with the solvent. The paint 80 is simultaneously delivered to the paint cannister or dosing device 64 and the piston 70 is retracted to receive the paint remaining in the delivery line 22 as shown by the arrow in 6I. Finally, the piston is again extended to deliver paint received by the dosing device 64 as shown in FIG. 6J through the inlet 66 to the ultimate source of paint, such as a color changer (not shown). As described in a co-pending U.S and EP. patent application, the paint delivery system may include two paint dosing devices 64 operating in tandem each having a delivery line connected to the applicator 62 and an inlet connected to the ultimate source of liquid paint, such as a paint cannister (not shown) to reduce cycle time.

The method of delivering solvent and paint from a source of liquid paint through a delivery line to an applicator of this invention will be understood from the description of FIGS. 6A to 6J, above. Briefly, the method of this invention includes locating first and second pigs or pigging elements 20A and 20B adjacent the source of liquid paint which, in the disclosed embodiment, is the paint cannister or dosing device 64. The method then includes delivering solvent 60 under pressure between the first and second pigs 20A and 20B, thereby spacing the first and second pigs with solvent 60. The method of this invention then includes driving paint 80 under pressure against an adjacent one of the first and second pigs 20A adjacent the source of liquid paint, thereby driving the first and second pigs with solvent therebetween through the delivery line 22 to the applicator 62, flushing the applicator and then driving paint 80 through the applicator 62 to apply paint to a substrate (not shown). In the preferred embodiment of the method of this invention, the source of liquid paint is a paint cannister or dosing device 64 having an outlet 68 communicating with the delivery line 22 and a piston 70 movable within the cannister, wherein the method of this invention includes driving the piston 70 in the cannister 64 to drive paint 80 under pressure against an adjacent one of the first and second pigs 20A and 20B, thereby first delivering solvent 60 to the applicator 62 and flushing the applicator, and then delivering paint 80 to the applicator 62 to apply paint to a substrate (not shown).

In a preferred embodiment of the method of this invention, as described above, the method of this invention further includes delivering solvent 60 under pressure between the first and second pigs 20A and 20B when the first and second pigs are located adjacent or within the applicator 62, then driving the first and second pigs from the applicator to the source of liquid paint, thereby flushing the delivery line 22 with solvent. Where the source of liquid paint is a piston dosing device 64, as described above, the first and second pigging elements 20A and 20B also deliver paint 80 remaining in the delivery line 24 to the piston dosing device 64 and the piston 70 is then extended to drive the paint 80 to the ultimate source of paint, such as a color changer (not shown).

As will be understood by those skilled in this art, FIGS. 6A to 6J are schematic and various modifications may be made to the apparatus and method of this invention within the purview of the appended claims. For example, the first pigging station 76 may include a solvent dump (not shown) which receives solvent following purging of the delivery line 22. Alternatively, a valve may be provided in the outlet 68 of the dosing device (not shown), which releases solvent through the outlet 68 following delivery of paint across the face of the piston head 72, thereby flushing the piston head, and a solvent dump may be provided in the inlet line 66. Further, the inlet line 66 may include a valve (not shown) which is closed when the piston 70 is extended as shown in FIG. 6D, preventing return of paint 80 to the color changer. Alternatively, as described in a co-pending application, the line 66 may also include a pigging element (not shown) which drives paint from the color changer (not shown) to the piston dosing device 64 and serves as a valve preventing return of paint to the color changer when the piston is extended as shown in FIG. 6D.

Also the step of delivering solvent e.g. at the second pig station 86 as described with reference to FIGS. 4 and 5 may be modified. In particular, when introducing the solvent between the two pigs 20A and 20B, the solvent may only move one of the pigs which is pushed into the line whereas the other pig remains at its initial position within the pig station until the complete amount of solvent is introduced.

There are several further possibilities of modifying the method as described above. For example, it may not be necessary to deliver solvent into the supply line 22 at the first pig station 76 for delivery thereof to the applicator 62. It may be sufficient to deliver solvent only from the second pig station 86 into the line 22 and to push it to the first station 76, from where the solvent may be returned to the second station 86 or may be delivered at least partly into the cannister 64.

An important further feature is the possibility of using a dosing cannister such as cannister 64 for dosing the amount of liquid solvent to be delivered into a supply line connected to the cannister, or into any other element of the system such as the cannister, itself. The essential feature of a method according to that possibility comprises delivering the solvent into said element while simultaneously retracting the piston of the canister, thereby dosing or metering the amount of delivered solvent by the retraction of the piston driven by the dosing drive means of the canister such as, for example, a servo motor. The retraction is controlled by program control means of the system. This feature makes it possible to first define a predetermined amount of solvent needed for a given purpose (usually cleaning), and then to deliver precisely the predetermined amount, thereby avoiding an unnecessary excess or waste of solvent, in contrast to systems where the amount of solvent delivered e.g. into a supply line is determined by valve switching times. An additional advantage of this feature is the fact that the solvent may be delivered with relatively and in some cases extremely low pressure.

When for example solvent is delivered from the source 46B into the line 22 following delivery of paint 80 to the applicator 62 as explained above with reference to FIG. 6G, the piston 70 of dosing cannister 64 may simultaneously be retracted, thereby dosing an initial amount of paint 80 introduced into the cannister and consequently the amount of solvent delivered on the side of pig 20A opposite to the paint 80. The delivery of solvent is stopped by the program control means when the piston has moved a predetermined distance. The solvent can then be pushed through line 22 between the two pigs 20A and 20B as explained above with reference to FIGS. 6H and 6I.

When the solvent 60 has reached the position as shown in FIG. 6I, it is possible to first extend the piston 70 to remove the paint 80 from the cannister through its inlet 66, whereupon at least a part of said solvent 60 may be delivered into the cannister by simultaneously retracting the piston, thereby dosing or metering the amount of delivered solvent. It is also possible to push the solvent 60 as shown in FIG. 6I or a part thereof between the two pigs 20A and 20B back to the second pig station adjacent or within the applicator 62.

The feature of dosing solvent delivered to an element of a paint conveying system by piston retraction may also be implemented at other locations of the system, for example between a color changer and the dosing cannister.

As set forth above, the apparatus and method of this invention is not limited to the improved pigging element 20 illustrated in FIGS. 1 to 3 which is also the subject of the above-referenced German patent application. Further, a conventional delivery line may be utilized with the apparatus and method of this invention. The term "paint," as used herein is generic to any liquid coating which may be applied by an applicator. The preferred solvent will depend upon the application. For example, where the paint is a water based paint, the solvent may be deionized water. Although the preferred embodiment of the apparatus of this invention includes a paint cannister having a piston or piston dosing device as described, the source of liquid paint may also be the color changer. Finally, the delivery line may include more than two pigging elements, wherein the additional pigging elements are utilized to separate other fluids delivered through the delivery line. Having described preferred embodiments of the apparatus and method of this invention, the invention is now claimed as set forth below.

The invention claimed is:

1. An apparatus for conveying liquid paint from a source of liquid paint to an applicator, comprising: a supply line between said source of liquid paint and said applicator delivering liquid paint from said source of liquid paint to said applicator, a first pig station adjacent said source of liquid paint and a second pig station adjacent or within said applicator, first and second pigs movable in said supply line between said first and second pig stations and a liquid solvent source connected to said first pig station and/or to said second pig station adapted to deliver solvent under pressure between said first and second pigs, whereby movement of said first and second pigs from said first station to said second station through said supply line delivers solvent to said applicator, thereby flushing said supply line and said applicator, and/or movement of said pigs from said second station to said first station delivers solvent flushing said supply line.

2. The apparatus as defined in claim 1, wherein said source of liquid paint is a paint cannister having an outlet communicating with said supply line and having a piston, whereby movement of said piston supplies paint under pressure through said supply line to said applicator.

3. The apparatus as defined in claim 2, wherein said outlet of said paint cannister communicates with said first pig station, whereby movement of said piston drives paint against and adjacent one of said first and second pigs opposite said outlet and said paint then driving said first and second pigs to said second pig station, thereby first delivering solvent to said applicator followed by paint.

4. The apparatus as defined in claim 3, wherein said piston is driven by an electric motor and/or a servo drive for dosing said liquid paint and/or said solvent.

5. The apparatus as defined in claim 1, wherein said apparatus further includes a source of nonconductive fluid under pressure connected to said second pig station opposite one of said first and second pigs driving said first and second pigs through said supply line from said second pig station to said first pig station, thereby delivering solvent through said supply line to said cannister, thereby flushing said supply line with solvent.

6. The apparatus as defined in claim 1, wherein each of said first and second pigs includes a sensor element and said apparatus includes a sensor in said first and/or second pig stations.

7. The apparatus as defined in claim 1, wherein said first and second pigs each include a body portion having an outer diameter adjacent opposed ends of said body portion generally equal to an inside diameter of said supply line and projecting end portions extending from said body portion which abut an adjacent pig, whereby delivery of solvent under pressure results in pressure against said body portions, and wherein said body portion includes a generally frustoconical skirt portion at said opposed ends of said body portion having a major diameter equal to or greater than said inside diameter of said supply line.

8. The apparatus as defined in claim 1, wherein said supply line includes an inside layer of a friction resistant polymer and a dielectric polymer surrounding said inside layer.

9. The apparatus as defined in claim 8, wherein said supply line further includes an outer layer formed of a hard polymer.

10. A method of delivering solvent and paint from a source of liquid paint through a delivery line having a first and second pig to an applicator, said method comprising the following steps: locating said first and second pigs adjacent said source of liquid paint; delivering solvent under pressure between said first and second pigs thereby spacing said first and second pigs with solvent; driving paint under pressure against and adjacent one of said first and second pigs adjacent said source of liquid paint, thereby driving said first and second pigs with said solvent therebetween to said applicator; said paint driving said solvent through said delivery line to said applicator, flushing said applicator, and then driving paint through said applicator applying said paint to a substrate; and/or said method comprising the following steps: locating said pigs adjacent or within said applicator; delivering solvent between said pigs; and driving said pigs with said solvent therebetween to said source, thereby flushing said delivery line.

11. The method as defined in claim 10, wherein said source of liquid paint is a cannister containing liquid paint, having an outlet communicating with said delivery line and a piston movable within said cannister, said method including driving said piston in said cannister to drive paint under pressure against said adjacent one of said first and second pigs with solvent between said first and second pigs from said source of liquid paint to said applicator.

12. The method of delivering solvent and paint as defined in claim 10, wherein said source of liquid paint is a cannister having a piston and said method includes driving said first and second pigs through said delivery line with solvent therebetween from said applicator to said cannister to flush said delivery line with solvent and delivering paint remaining in said delivery line to said cannister.

13. The method as defined in claim 10, wherein said source of liquid paint comprises a dosing cylinder having a piston driven by a servo drive, and said solvent is delivered between said pigs adjacent or within said applicator while simultaneously retracting said piston of said source thereby dosing the amount of solvent by driving said piston.

14. A method of delivering liquid solvent into an element of a system for conveying liquid paint from a source to an applicator, particularly as defined in claim 10, said system including a delivery line connected to a paint cannister having a piston movable within said canister and driven by dosing drive means, the method comprising the steps of driving a pig through said delivery line for pushing paint or solvent into said cannister; and delivering said solvent into said element while simultaneously retracting said piston, thereby dosing the amount of solvent delivered into said element by the retraction of the piston driven by said dosing drive means.

15. The method as defined in claim 14, wherein said pig is driven through said delivery line for pushing paint from said line into said canister, and said solvent is delivered into said line on the side of the pig opposite to said paint while simultaneously retracting said piston.

16. The method as defined in claim 14, comprising the steps of delivering solvent into said delivery line, driving a pig through said line for pushing said solvent to said cannister, and then delivering a predetermined amount of solvent into the canister by retracting said piston.

17. The method as defined in claim 14, wherein said paint and solvent delivery line includes an outer layer of a protective polymer.

* * * * *

UNITED STATES PATENT AND TRADEMARK OFFICE

CERTIFICATE OF CORRECTION

PATENT NO. : 7,584,771 B2
APPLICATION NO. : 10/512929
DATED : September 8, 2009
INVENTOR(S) : Herre et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 951 days.

Signed and Sealed this

Fourteenth Day of September, 2010

David J. Kappos

David J. Kappos
*Director of the United States Patent and Trademark Office*